US011401591B2

(12) United States Patent
Honjo et al.

(10) Patent No.: US 11,401,591 B2
(45) Date of Patent: Aug. 2, 2022

(54) METHOD FOR SELECTING RAIL STEEL AND WHEEL STEEL

(71) Applicant: JFE STEEL CORPORATION, Tokyo (JP)

(72) Inventors: Minoru Honjo, Tokyo (JP); Tatsumi Kimura, Tokyo (JP); Katsuyuki Ichimiya, Tokyo (JP); Kazukuni Hase, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 495 days.

(21) Appl. No.: 16/061,464

(22) PCT Filed: Dec. 14, 2016

(86) PCT No.: PCT/JP2016/087276

§ 371 (c)(1),
(2) Date: Jun. 12, 2018

(87) PCT Pub. No.: WO2017/104719

PCT Pub. Date: Jun. 22, 2017

(65) Prior Publication Data

US 2019/0249280 A1 Aug. 15, 2019

(30) Foreign Application Priority Data

Dec. 15, 2015 (JP) ..... JP2015-244419

(51) Int. Cl.

| | |
|---|---|
| ***C22C 38/32*** | (2006.01) |
| ***C22C 38/18*** | (2006.01) |
| ***C22C 38/00*** | (2006.01) |
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/42*** | (2006.01) |
| *C21D 9/04* | (2006.01) |

(52) U.S. Cl.

CPC ..... *C22C 38/32* (2013.01); *C22C 38/00* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/28* (2013.01); *C22C 38/42* (2013.01); *C22C 38/54* (2013.01); *C21D 9/04* (2013.01)

(58) Field of Classification Search

CPC .. B21H 1/08; C21D 9/04; C22C 38/02; C22C 38/04; C22C 38/08; C22C 38/12; C22C 38/14; C22C 38/16; C22C 38/18; C22C 38/20; C22C 38/22; C22C 38/24; C22C 38/26; C22C 38/28; C22C 38/32; C22C 38/40; C22C 38/42; C22C 38/44; C22C 38/46; C22C 38/48; C22C 38/50; C22C 38/54

See application file for complete search history.

(56) References Cited

U.S. PATENT DOCUMENTS

| | | | | |
|---|---|---|---|---|
| 3,726,724 A * | 4/1973 | Davies et al. | ..... | C22C 38/12 420/104 |
| 7,972,451 B2 * | 7/2011 | Ueda | ..... | C22C 38/002 148/333 |
| 2009/0053095 A1 * | 2/2009 | Robles Hernandez | ..... | C22C 38/02 420/90 |

(Continued)

FOREIGN PATENT DOCUMENTS

| | | |
|---|---|---|
| CA | 2907609 C | 12/2017 |
| JP | H0892645 A | 4/1996 |

(Continued)

OTHER PUBLICATIONS

Lewis, R. Olofsson, U.. (2009). Wheel-Rail Interface Handbook—6.6.1 Use of Friction Modifiers. Woodhead Publishing. Retrieved from https://app.knovel.eom/hotlink/pdf/id:kt0079EUP1/wheel-rail-interface/use-friction-modifiers (Year: 2009).*

D. Markov, Laboratory tests for wear of rail and wheel steels,Wear,vols. 181-183, Part 2, 1995, pp. 678-686, ISSN 0043-1648,https://doi.org/10.1016/0043-1648(95)90184-1. (https://www.sciencedirect.com/science/article/pii/0043164895901841) (Year: 1995).*

Feb. 28, 2017, International Search Report issued in the International Patent Application No. PCT/2016/087276.

Jul. 15, 2019, Office Action issued by the Canadian Intellectual Property Office in the corresponding Canadian Patent Application No. 3,006,945.

(Continued)

*Primary Examiner* — Alexandra M Moore

(74) *Attorney, Agent, or Firm* — Kenja IP Law PC

(57) ABSTRACT

A method for selecting a rail steel and a wheel steel comprising: selecting a rail steel and a wheel steel to be used as a rail and a wheel on an actual track, respectively, the rail steel and the wheel steel having a specific chemical composition, such that the rail comprises a head portion having a yield strength $YS_R$ of 830 MPa or more, the wheel comprises a rim portion having a yield strength $YS_W$ of 580 MPa or more, and a ratio $YS_R/YS_W$ of the yield strength $YS_R$ at the head portion of the rail to the yield strength $YS_W$ at the rim portion of the wheel falls within a range of: $0.85 \leq YS_R/YS_W \leq 1.95$ (1).

4 Claims, 1 Drawing Sheet

(56) References Cited

U.S. PATENT DOCUMENTS

| | | | | |
|---|---|---|---|---|
| 2012/0015212 | A1 | 1/2012 | Karimine et al. | |
| 2015/0147224 | A1 | 5/2015 | Yamamoto et al. | |
| 2015/0152516 | A1 * | 6/2015 | Kimura ..... | C21D 6/008<br>219/55 |

FOREIGN PATENT DOCUMENTS

| | | | | |
|---|---|---|---|---|
| JP | 2004315928 | A | 11/2004 | |
| JP | 2012030242 | A | 2/2012 | |
| JP | 2013147725 | A | 8/2013 | |
| JP | 2013224472 | A | 10/2013 | |
| JP | 2013231212 | A | 11/2013 | |
| JP | 2015504484 | A | 2/2015 | |
| WO | 2010116680 | A1 | 10/2010 | |
| WO | 2013079438 | A1 | 6/2013 | |
| WO | WO-2013161026 | A1 * | 10/2013 | ..... C21D 6/004 |

OTHER PUBLICATIONS

Sergey M. Zakharov, Wheel and Rail Performance, The Asian Journal, 2006, vol. 13, No. 1.

Jan. 12, 2021, Office Action issued by the Canadian Intellectual Property Office in the corresponding Canadian Patent Application No. 3,006,945.

* cited by examiner

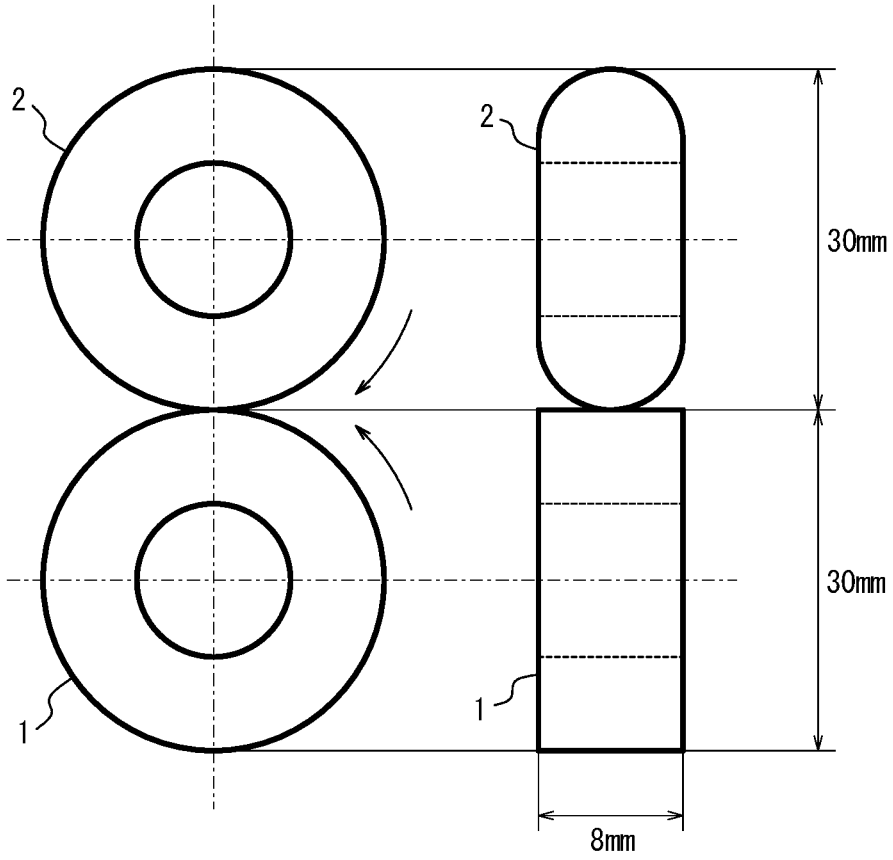
2
2
30mm
30mm
1
1
8mm

METHOD FOR SELECTING RAIL STEEL AND WHEEL STEEL

TECHNICAL FIELD

The present disclosure relates to a method for selecting a rail steel and a wheel steel that is capable of suppressing fatigue damage in a rail and a railway wheel used in a railway track and of extending the service life of both the rail and the wheel by controlling the ratio of the yield strength at a head portion of the rail to the yield strength at a rim portion of the wheel.

BACKGROUND

In heavy haul railways mainly built to transport ore, the load applied to the axle of a freight car is much higher than that in passenger cars, and rails and wheels are used in increasingly harsh environments. For rails and wheels used under such circumstances, conventional rail steels primarily have a pearlite structure from the viewpoint of the importance of wear resistance and have a yield strength of 800 MPa or less, which may vary depending on the operating environment. Similarly, wheel steels having a yield strength of 500 MPa or less are conventionally used for railway wheels.

In recent years, however, in order to improve the efficiency of transportation by railway, the loading weight on freight cars is becoming larger and larger, and consequently, there is a need for further improvement of durability of rail steels and wheel steels. It is noted that heavy haul railways are railways where trains and freight cars haul large loads (loading weight is about 150 tons, for example).

Under such circumstances, for example, JP2004315928A (PTL 1) proposes a wheel for high-carbon railway vehicles in which wear resistance and thermal crack resistance are improved by increasing the C content to 0.85% to 1.20%. JP2013147725A (PTL 2) proposes a method for reducing the wear of rails and wheels by controlling the ratio of the rigidity of the rail steel and the hardness of the wheel steel.

CITATION LIST

Patent Literature

PTL 1: JP2004315928A
PTL 2: JP2013147725A

SUMMARY

Technical Problem

On the other hand, as described above, since the operating environments of rails and wheels are becoming more severe, rails and wheels suffer from fatigue damage. In particular, in curve sections of a heavy haul railway, it is required to suppress fatigue damage resulting from the rolling stress exerted by wheels and the sliding force due to centrifugal force.

However, in the technique described in JP2004315928A (PTL 1), although the wear resistance and the thermal crack resistance of the wheel are improved to some extent, the C content is as high as 0.85% to 1.20%, which makes it difficult to improve fatigue damage resistance. This is because as a result of steel containing a large amount of C, a proeutectoid cementite structure is formed depending on heat treatment conditions and the amount of cementite phase contained in a pearlite lamellar structure increases.

Further, in PTL 2, since attention is paid only to the relationship between the rail and the hardness of the wheel (Vickers hardness), although it is possible to suppress wear, it is difficult to suppress fatigue damage.

It would thus be helpful to provide a method for selecting a rail steel and a wheel steel that is capable of suppressing fatigue damage in a rail used in a railway track and of a railway wheel, and that can extend the service life of both the rail and the wheel.

Solution to Problem

In order to address the above issues, we made rail steels and wheel steels with varying contents of C, Si, Mn, and Cr, and extensively investigated the relationship between yield strength and fatigue damage resistance. Our investigations revealed that by setting the ratio $YS_R/YS_W$ of the yield strength $YS_R$ at a head portion of a rail and the yield strength $YS_W$ at a rim portion of a wheel to 0.85 or more and 1.95 or less, it is possible to suppress the fatigue damage in the rail and the wheel.

The present disclosure is based on the findings described above and has the following primary features.

1. A method for selecting a rail steel and a wheel steel comprising: selecting a rail steel and a wheel steel to be used as a rail and a wheel on an actual track, respectively, the rail steel having a chemical composition containing, by mass %, C: 0.70% or more and less than 0.85%, Si: 0.10% to 1.50%, Mn: 0.40% to 1.50%, and Cr: 0.05% to 1.50%, with the balance of Fe and inevitable impurities, the wheel steel having a chemical composition containing, by mass %, C: 0.57% or more and less than 0.85%, Si: 0.10% to 1.50%, Mn: 0.40% to 1.50%, and Cr: 0.05% to 1.50%, with the balance of Fe and inevitable impurities, such that the rail comprises a head portion having a yield strength $YS_R$ of 830 MPa or more, the wheel comprises a rim portion having a yield strength $YS_W$ of 580 MPa or more, and a ratio $YS_R/YS_W$ of the yield strength $YS_R$ at the head portion of the rail to the yield strength $YS_W$ at the rim portion of the wheel falls within a range of:

$$0.85 \leq YS_R/YS_W \leq 1.95 \quad (1).$$

The method for selecting a rail steel and a wheel steel according to 1. above, wherein the chemical composition of the rail steel further contains, by mass %, at least one selected from the group consisting of Cu: 1.0% or less, Ni: 1.0% or less, V: 0.30% or less, Nb: 0.05% or less, Mo: 0.5% or less, W: 0.5% or less, Al: 0.07% or less, Ti: 0.05% or less, and B: 0.005% or less.

The method for selecting a rail steel and a wheel steel according to 1. or 2. above, wherein the chemical composition of the wheel steel further contains, by mass %, at least one selected from the group consisting of Cu: 1.0% or less, Ni: 1.0% or less, V: 0.30% or less, Nb: 0.05% or less, Mo: 0.5% or less, W: 0.5% or less, Al: 0.07% or less, Ti: 0.05% or less, and B: 0.005% or less.

Advantageous Effect

According to the present disclosure, by using a rail steel and a wheel steel having predetermined chemical compositions and by controlling the ratio of the yield strength of the resulting rail to that of the resulting wheel, it is possible to suppress the fatigue damage in the rail and the wheel, lengthening the service life of both.

BRIEF DESCRIPTION OF THE DRAWING

FIG. 1 schematically illustrates a fatigue damage test method.

DETAILED DESCRIPTION

Detailed description is given below. In the present disclosure, it is important that a rail steel and a wheel steel have the above-described chemical compositions. The reasons for limiting the chemical compositions as stated above are described first. The unit of the content of each component is "mass %", but it is abbreviated as "%".

[Chemical Composition of Rail Steel]

C: 0.70% or More and Less than 0.85%

C is an element that forms cementite in a pearlite structure and has the effect of securing yield strength and fatigue damage resistance. If the C content is less than 0.70%, the yield strength decreases, making it difficult to obtain excellent fatigue damage resistance. On the other hand, when the C content is 0.85% or more, pro-eutectoid cementite is formed at austenite grain boundaries at the time of transformation after hot rolling, and the fatigue damage resistance is remarkably deteriorated. Therefore, the C content is set to 0.70% or more and less than 0.85%.

Si: 0.10% to 1.50%

Si is an element that is added as a deoxidizer and as a pearlite-structure-strengthening element. To obtain the addition effect of Si, the Si content needs to be 0.10% or more. On the other hand, a Si content beyond 1.50% leads to an excessive increase in the yield strength, which ends up making the counterpart material, the wheel steel, prone to fatigue damage. Therefore, the Si content is set in a range of 0.10% to 1.50%.

Mn: 0.40% to 1.50%

Mn is an element that contributes to achieving high yield strength of the rail by decreasing the pearlite transformation temperature to refine the lamellar spacing. When the Mn content is below 0.40%, however, this effect cannot be obtained sufficiently. On the other hand, a Mn content beyond 1.50% leads to an excessive increase in the yield strength, which ends up making the counterpart material, the wheel steel, prone to fatigue damage. Therefore, the Mn content is set in a range of 0.40% to 1.50%.

Cr: 0.05% to 1.50%

Cr is an element that has the effect of increasing the pearlite equilibrium transformation temperature to refine the lamellar spacing and improving the yield strength by solid solution strengthening. When the Cr content is below 0.05%, however, sufficient yield strength cannot be obtained. On the other hand, a Cr content beyond 1.50% leads to an excessive increase in the yield strength, which ends up making the counterpart material, the wheel steel, prone to fatigue damage. Therefore, the Cr content is set to 0.05% to 1.50%.

The rail steel in one embodiment of the present disclosure has a chemical composition containing the above components with the balance of Fe and inevitable impurities. Examples of the inevitable impurities include P and S, and up to 0.025% of P and up to 0.025% of S are allowable. On the other hand, a lower limit for the P content and the S content may be 0% without limitation, yet the lower limit is more than 0% in industrial terms. In addition, since excessively reducing the contents of P and S leads to an increase in the refining cost, the P content and the S content are preferably 0.0005% or more. The chemical composition of the rail steel of the present disclosure preferably consists of the above components and the balance of Fe and inevitable impurities, or alternatively, in addition to these, optional components as specified below. However, rail steels containing other trace elements within a range not substantially affecting the action and effect of the present disclosure are also encompassed by the present disclosure.

Optionally, the chemical composition of the rail steel may further contain, by mass %, at least one selected from the group consisting of Cu: 1.0% or less, Ni: 1.0% or less, V: 0.30% or less, Nb: 0.05% or less, Mo: 0.5% or less, W: 0.5% or less, Al: 0.07% or less, Ti: 0.05% or less, and B: 0.005% or less.

V: 0.30% or Less

V is an element that has the effect of improving the yield strength by dispersing and precipitating in the matrix by forming carbides or nitrides. On the other hand, a V content beyond 0.30% leads to an excessive increase in the yield strength, which ends up making the counterpart material, the wheel steel, prone to fatigue damage. Also, since V is an expensive element, the cost of rail steel increases. Therefore, in the case of adding V, it is preferable to set the V content to 0.30% or less. The lower limit of the V content is not particularly limited, yet from the viewpoint of improving the yield strength, it is preferable to set the V content to 0.001% or more.

Cu: 1.0% or Less

Like Cr, Cu is an element having the effect of improving the yield strength by solid solution strengthening. However, when the Cu content exceeds 1.0%, Cu cracking is liable to occur. Therefore, in the case of adding Cu, it is preferable to set the Cu content to 1.0% or less. The lower limit of the Cu content is not particularly limited, yet from the viewpoint of improving the yield strength, it is preferable to set the Cu content to 0.001% or more.

Ni: 1.0% or Less

Ni is an element that has the effect of improving the yield strength without deteriorating the ductility. In addition, in the case of adding Cu, it is preferable to add Ni because Cu cracking can be suppressed by the addition of Ni in combination with Cu. When the Ni content exceeds 1.0%, however, the quench hardenability increases and martensite is formed, with the result that the fatigue damage resistance tends to decrease. Therefore, in the case of adding Ni, it is preferable to set the Ni content to 1.0% or less. The lower limit of the Ni content is not particularly limited, yet from the viewpoint of improving the yield strength, it is preferable to set the Ni content to 0.001% or more.

Nb: 0.05% or Less

Nb bonds to C or N in the steel to form precipitates as carbides, nitrides, or carbonitrides during and after rolling, and effectively acts to increase the yield strength. Therefore, by adding Nb, the fatigue damage resistance can be greatly improved and the service life of the rail can be further extended. However, a Nb content beyond 0.05% leads to an excessive increase in the yield strength, which ends up making the counterpart material, the wheel steel, prone to fatigue damage. Therefore, in the case of adding Nb, it is preferable to set the Nb content to 0.05% or less. The lower limit of the Nb content is not particularly limited, yet from the viewpoint of improving the yield strength, it is preferable to set the Nb content to 0.001% or more.

Mo: 0.5% or Less

Mo is an element having the effect of improving the yield strength by solid solution strengthening. However, a Mo content beyond 0.5% leads to an excessive increase in the yield strength, which ends up making the counterpart material, the wheel steel, prone to fatigue damage. Therefore, in the case of adding Mo, it is preferable to set the Mo content to 0.5% or less. The lower limit of the Mo content is not particularly limited, yet from the viewpoint of improving the yield strength, it is preferable to set the Mo content to 0.001% or more.

W: 0.5% or Less

W is an element having the effect of improving the yield strength by solid solution strengthening. However, a W content beyond 0.5% leads to an excessive increase in the yield strength, which ends up making the counterpart material, the wheel steel, prone to fatigue damage. Therefore, in the case of adding W, it is preferable to set the W content to 0.5% or less. The lower limit of the W content is not particularly limited, yet from the viewpoint of improving the yield strength, it is preferable to set the W content to 0.001% or more.

Al: 0.07% or Less

Al bonds to N in the steel to form precipitates as nitrides during and after rolling, and effectively acts to increase the yield strength. Therefore, by adding Al, the fatigue damage resistance can be greatly improved and the service life of the rail can be further extended. However, when the Al content exceeds 0.07%, a large amount of oxides is produced in the steel, which ends up making the rail steel prone to fatigue damage. Therefore, in the case of adding Al, it is preferable to set the Al content to 0.07% or less. The lower limit of the Al content is not particularly limited, yet from the viewpoint of improving the yield strength, it is preferable to set the Al content to 0.001% or more.

B: 0.005% or Less

B precipitates as nitrides during and after rolling, and effectively acts to increase the yield strength by precipitation strengthening. Therefore, by adding B, the fatigue damage resistance can be greatly improved and the service life of the rail can be further extended. However, a B content beyond 0.005% leads to an excessive increase in the yield strength, which ends up making the counterpart material, the wheel steel, prone to fatigue damage. Therefore, in the case of adding B, it is preferable to set the B content to 0.005% or less. The lower limit of the B content is not particularly limited, yet from the viewpoint of improving the yield strength, it is preferable to set the B content to 0.0001% or more.

Ti: 0.05% or Less

Ti forms precipitates as carbides, nitrides, and carbonitrides during and after rolling, and effectively acts to increase the yield strength by precipitation strengthening. Therefore, by adding Ti, the fatigue damage resistance can be greatly improved and the lift of the rail can be further extended. However, when the Ti content exceeds 0.05%, coarse carbides, nitrides, or carbonitrides are formed, which ends up lowering the fatigue damage resistance of the rail. Therefore, in the case of adding Ti, it is preferable to set the Ti content to 0.05% or less. The lower limit of the Ti content is not particularly limited, yet from the viewpoint of improving the yield strength, it is preferable to set the Ti content to 0.001% or more.

[Chemical Composition of Wheel Steel]

C: 0.57% or More and Less than 0.85%

C is an element that forms cementite in a pearlite structure and has the effect of securing yield strength and fatigue damage resistance. If the C content is less than 0.57%, the yield strength decreases, making it difficult to obtain excellent fatigue damage resistance. On the other hand, if the C content is 0.85% or more, pro-eutectoid cementite is formed at austenite grain boundaries at the time of transformation after hot rolling, and the fatigue damage resistance is remarkably deteriorated. Therefore, the C content is set to 0.57% or more and less than 0.85%.

Si: 0.10% to 1.50%

Si is an element that is added as a deoxidizer and as a pearlite-structure-strengthening element. To obtain the addition effect of Si, the Si content needs to be 0.10% or more. On the other hand, a Si content beyond 1.50% leads to an excessive increase in the yield strength, which ends up making the counterpart material, the rail steel, prone to fatigue damage. Therefore, the Si content is set in a range of 0.10% to 1.50%.

Mn: 0.40% to 1.50%

Mn is an element that contributes to achieving high yield strength of the wheel by decreasing the pearlite transformation temperature to refine the lamellar spacing. When the Mn content is less than 0.40%, however, this effect cannot be obtained sufficiently. On the other hand, a Mn content beyond 1.50% leads to an excessive increase in the yield strength, which ends up making the counterpart material, the rail steel, prone to fatigue damage. Therefore, the Mn content is set in a range of 0.40% to 1.50%.

Cr: 0.05% to 1.50%

Cr is an element that has the effect of increasing the pearlite equilibrium transformation temperature to refine the lamellar spacing and improving the yield strength by solid solution strengthening. When the Cr content is below 0.05%, however, sufficient yield strength cannot be obtained. On the other hand, a Cr content beyond 1.50% leads to an excessive increase in the yield strength, which ends up making the counterpart material, the rail steel, prone to fatigue damage. Therefore, the Cr content is set to 0.05% to 1.50%.

The wheel steel in one embodiment of the present disclosure has a chemical composition containing the above components with the balance of Fe and inevitable impurities. Examples of the inevitable impurities include P and S, and up to 0.030% of P and up to 0.030% of S are allowable. On the other hand, a lower limit for the P content and the S content may be 0% without limitation, yet it is more than 0% in industrial terms. In addition, since excessively reducing the contents of P and S leads to an increase in the refining cost, the P content and the S content are preferably 0.0005% or more. The chemical composition of the wheel steel of the present disclosure preferably consists of the above components and the balance of Fe and inevitable impurities, or alternatively, in addition to these, optional components as specified below. However, wheel steels containing other trace elements within a range not substantially affecting the action and effect of the present disclosure are also encompassed by the present disclosure.

Optionally, the chemical composition of the wheel steel may further contain, by mass %, at least one selected from the group consisting of Cu: 1.0% or less, Ni: 1.0% or less, V: 0.30% or less, Nb: 0.05% or less, Mo: 0.5% or less, W: 0.5% or less, Al: 0.07% or less, Ti: 0.05% or less, and B: 0.005% or less.

V: 0.30% or Less

V is an element that has the effect of improving the yield strength by dispersing and precipitating in the matrix by forming carbides or nitrides. On the other hand, a V content beyond 0.30% leads to an excessive increase in the yield strength, which ends up making the counterpart material, the rail steel, prone to fatigue damage. Also, since V is an expensive element, the cost of the wheel steel increases. Therefore, in the case of adding V, it is preferable to set the V content to 0.30% or less. The lower limit of the V content is not particularly limited, yet from the viewpoint of improving the yield strength, it is preferable to set the V content to 0.001% or more.

Cu: 1.0% or Less

Like Cr, Cu is an element having an effect of improving the yield strength by solid solution strengthening. However, when the Cu content exceeds 1.0%, Cu cracking is liable to occur. Therefore, in the case of adding Cu, it is preferable to set the Cu content to 1.0% or less. The lower limit of the Cu content is not particularly limited, yet from the viewpoint of improving the yield strength, it is preferable to set the Cu content to 0.001% or more.

Ni: 1.0% or Less

Ni is an element that has an effect of improving the yield strength without deteriorating the ductility. In addition, in the case of adding Cu, it is preferable to add Ni because Cu cracking can be suppressed by the addition of Ni in combination with Cu. When the Ni content exceeds 1.0%, however, the quench hardenability increases and martensite is formed, with the result that the fatigue damage resistance tends to decrease. Therefore, in the case of adding Ni, it is preferable to set the Ni content to 1.0% or less. The lower limit of the Ni content is not particularly limited, yet from the viewpoint of improving the yield strength, it is preferable to set the Ni content to 0.001% or more.

Nb: 0.05% or Less

Nb bonds to C or N in the steel to form precipitates as carbides, nitrides, or carbonitrides during and after rolling, and effectively acts to increase the yield strength. Therefore, by adding Nb, the fatigue damage resistance can be greatly improved and the service life of the wheel can be further extended. However, a Nb content beyond 0.05% leads to an excessive increase in the yield strength, which ends up making the counterpart material, the rail steel, prone to fatigue damage. Therefore, in the case of adding Nb, it is preferable to set the Nb content to 0.05% or less. The lower limit of the Nb content is not particularly limited, yet from the viewpoint of improving the yield strength, it is preferable to set the Nb content to 0.001% or more.

Mo: 0.5% or Less

Mo is an element having an effect of improving the yield strength by solid solution strengthening. However, a Mo content beyond 0.5% leads to an excessive increase in the yield strength, which ends up making the counterpart material, the rail steel, prone to fatigue damage. Therefore, in the case of adding Mo, it is preferable to set the Mo content to 0.5% or less. The lower limit of the Mo content is not particularly limited, yet from the viewpoint of improving the yield strength, it is preferable to set the Mo content to 0.001% or more.

W: 0.5% or Less

W is an element having an effect of improving the yield strength by solid solution strengthening. However, a W content beyond 0.5% leads to an excessive increase in the yield strength, which ends up making the counterpart material, the rail steel, prone to fatigue damage. Therefore, in the case of adding W, it is preferable to set the W content to 0.5% or less. The lower limit of the W content is not particularly limited, yet from the viewpoint of improving the yield strength, it is preferable to set the W content to 0.001% or more.

Al: 0.07% or Less

Al bonds to N in the steel to form precipitates as nitrides during and after rolling, and effectively acts to increase the yield strength. Therefore, by adding Al, the fatigue damage resistance can be greatly improved and the service life of the wheel can be further extended. However, when the Al content exceeds 0.07%, a large amount of oxides is produced in the steel, which ends up making the wheel steel prone to fatigue damage. Therefore, in the case of adding Al, it is preferable to set the Al content to 0.07% or less. The lower limit of the Al content is not particularly limited, yet from the viewpoint of improving the yield strength, it is preferable to set the Al content to 0.001% or more.

B: 0.005% or Less

B precipitates as nitrides during and after rolling, and effectively acts to increase the yield strength by precipitation strengthening. Therefore, by adding B, the fatigue damage resistance can be greatly improved and the service life of the wheel can be further extended. However, a B content beyond 0.005% leads to an excessive increase in the yield strength, which ends up making the counterpart material, the rail steel, prone to fatigue damage. Therefore, in the case of adding B, it is preferable to set the B content to 0.005% or less. The lower limit of the B content is not particularly limited, yet from the viewpoint of improving the yield strength, it is preferable to set the B content to 0.0001% or more.

Ti: 0.05% or Less

Ti forms precipitates as carbides, nitrides, and carbonitrides during and after rolling, and effectively acts to increase the yield strength by precipitation strengthening. Therefore, by adding Ti, the fatigue damage resistance can be greatly improved and the service life of the wheel can be further extended. However, when the Ti content exceeds 0.05%, coarse carbides, nitrides, or carbonitrides are formed, which ends up lowering the fatigue damage resistance of the wheel. Therefore, in the case of adding Ti, it is preferable to set the Ti content to 0.05% or less. The lower limit of the Ti content is not particularly limited, yet from the viewpoint of improving the yield strength, it is preferable to set the Ti content to 0.001% or more.

[Yield Strength Ratio $YS_R/YS_W$]

In the present disclosure, a rail steel and a wheel steel to be used as a rail and a wheel on an actual track, respectively, having the above-described chemical compositions are selected such that the rail comprises a head portion having a yield strength $YS_R$, the wheel comprises a rim portion having a yield strength $YS_W$, and a $YS_R/YS_W$ ratio falls within a range of:

$$0.85 \leq YS_R/YS_W \leq 1.95 \quad (1).$$

In this case, the yield strength $YS_R$ of the rail is determined by collecting a tensile test specimen with a parallel portion of 0.25 inch or 0.5 inch as specified in ASTM A370 from a position as specified in AREMA Chapter 4, 2.1.3.4, and subjecting it to a tensile test. The yield strength $YS_W$ of the wheel is obtained by collecting a tensile test specimen similar to that obtained in the rail test from a position described in AAR Specification M-107/M-208, 3.1.1., and subjecting it to a tensile test.

The fatigue damage resistance of the rail steel and of the wheel steel depends on the yield strength of each. It is thus believed that the fatigue damage in the rail and the wheel can be suppressed by increasing the yield strength. However, if the ratio of the yield strength of the rail steel to the yield strength of the wheel steel is not in an appropriate range, the fatigue damage resistance is rather lowered due to the accumulation of fatigue layers. If the $YS_R/YS_W$ ratio is below 0.85, the yield strength of the rail steel is too low, the yield strength of the wheel steel is too high, or both. If the yield strength of the rail steel is low, the fatigue damage resistance of the rail steel itself decreases, and the rail steel is consequently prone to fatigue damage. Also, if the yield strength of the wheel steel is high, fatigue layers accumulate in the rail steel as the counterpart material, which ends up causing fatigue damage to occur in the rail steel easily. If the $YS_R/YS_W$ ratio is beyond 1.95, the yield strength of the wheel steel is too low, the yield strength of the rail steel is too high, or both. When the yield strength of the wheel steel is low, the fatigue damage resistance of the wheel steel itself decreases, and the wheel steel is consequently prone to fatigue damage. Also, if the yield strength of the rail steel is high, fatigue layers accumulate in the wheel steel as the counterpart material, which ends up causing fatigue damage to occur in the wheel steel easily. Therefore, the $YS_R/YS_W$ ratio is set to 0.85 or more and 1.95 or less. The $YS_R/YS_W$ ratio is preferably 0.86 or more. The $YS_R/YS_W$ ratio is preferably 1.90 or less.

[Yield Strength $YS_R$ at Head Portion of Rail]

Since the fatigue damage resistance of the rail itself can be further enhanced by increasing the yield strength $YS_R$ at the head portion of the rail, $YS_R$ is set to 830 MPa or more. Although no upper limit is placed on $YS_R$, excessively increasing $YS_R$ makes it difficult to satisfy the condition of formula (1). Thus, a preferred upper limit is 1200 MPa.

When a rail is produced by hot rolling a steel raw material into a rail shape and cooling it, the yield strength $YS_R$ at the head portion of the rail can be adjusted by controlling the heating temperature before hot rolling and the cooling rate in cooling after hot rolling. In other words, since the yield strength $YS_R$ becomes higher as the heating temperature becomes higher and the cooling rate after hot rolling becomes higher, the heating temperature and the cooling rate may be adjusted for the targeted $YS_R$.

[Yield Strength $YS_W$ at Rim Portion of Wheel]

By increasing the yield strength $YS_W$ at the rim portion of the wheel, the fatigue damage resistance of the wheel itself can be enhanced. Therefore, the $YS_W$ is set to 580 MPa or more. Although no upper limit is placed on $YS_W$, excessively increasing $YS_W$ makes it difficult to satisfy the condition of formula (1). Thus, a preferred upper limit is 1000 MPa.

When a wheel is formed by hot working such as hot rolling and hot forging, the yield strength $YS_W$ at the rim portion of the wheel can be adjusted by controlling the heating temperature before hot working and the cooling rate in cooling after hot working. In other words, since the yield strength $YS_W$ becomes higher as the heating temperature becomes higher and the cooling rate after hot rolling becomes higher, the heating temperature and the cooling rate may be adjusted for the targeted $YS_W$.

[Steel Microstructure of Rail Steel and Wheel Steel]

In the rail steel, the steel microstructure of the head portion of the rail is preferably a pearlite structure. This is because the pearlite structure has better fatigue damage resistance than the tempered martensite structure and the bainite structure.

Also, in the wheel steel, the steel microstructure of the rim portion of the wheel is preferably a pearlite structure. This is because a pearlite structure has excellent fatigue damage resistance as compared with the tempered martensite structure and the bainite structure as described above.

In order to make the steel microstructure of the head portion of the rail steel into a pearlite structure, the steel raw material is heated to 1000° C. to 1300° C. and then hot rolled. Then, air cooling is performed to 400° C. at a cooling rate of 0.5° C./s to 3° C./s.

Further, in order to make the steel microstructure of the rim portion of the wheel steel into a pearlite structure, the steel material is heated to 900° C. to 1100° C. and then hot forged. Then, air cooling is performed to 400° C. at a cooling rate of 0.5° C./s to 3° C./s.

EXAMPLES

We evaluated the effect of the yield strength ratio $YS_R/YS_W$ on the occurrence of fatigue damage. Evaluation of fatigue damage is desirably carried out by using rails and wheels on an actual track, yet this process requires an extremely long test time. Therefore, in the examples below, the occurrence of fatigue damage was evaluated using test specimens fabricated from a rail steel and a wheel steel, respectively, and carrying out tests simulating a set of actual contact conditions between the rail and the wheel using a two-cylinder testing machine. At that time, the rail steel specimen and the wheel steel specimen were produced under a set of conditions simulating the head portion of the rail and the rim portion of the wheel, respectively. The specific production conditions and test methods are as follows.

Example 1

In this case, 100 kg of steels having the chemical compositions in Table 1 were each subjected to vacuum melting and hot rolled to a thickness of 80 mm. Each rolled material thus obtained was cut to a length of 150 mm, heated to 1000° C. to 1300° C., and hot rolled to a final sheet thickness of 12 mm. Then, air cooling was performed to 400° C. at a cooling rate of 0.5° C./s to 3° C./s, and then allowed to cool to obtain a rail steel. At this time, the yield strength of the finally obtained rail steel was controlled by adjusting the heating temperature and the cooling rate before the hot rolling.

Similarly, 100 kg of steels having the chemical compositions in Table 2 were each subjected to vacuum melting and hot rolled to a thickness of 80 mm. Each rolled material thus obtained was cut to a length of 150 mm, heated to 900° C. to 1100° C., and hot rolled to a final sheet thickness of 12 mm. Then, air cooling was performed to 400° C. at a cooling rate of 0.5° C./s to 3° C./s, and then allowed to cool. At this time, the yield strength of the finally obtained wheel steel was controlled by adjusting the heating temperature and the cooling rate before the hot rolling.

Yield Strength

The yield strength of each rail steel and wheel steel thus obtained was evaluated by a tensile test in accordance with ASTM A370. From each rail steel and wheel steel, a tensile test specimen having a parallel portion diameter of 0.25 inch (6.35 mm) as prescribed in ASTM A370 was collected and subjected to a tensile test at a tensile rate of 1 mm/min, where a 0.2% proof stress was determined from the stress-strain curve and used as the yield strength. The measured values are presented in Table 2.

Steel Microstructure

After polishing the surface of each obtained rail steel and wheel steel to a mirror surface, it was etched with nital, and microstructure observation was carried out at ×100 magnification.

Fatigue Damage

Test specimens with a diameter of 30 mm were prepared from each obtained rail steel and wheel steel with a contact surface being a curved surface having a radius of curvature of 15 mm. Then, in each combination of a rail steel and a wheel steel listed in Table 3, the occurrence of fatigue damage was evaluated using a two-cylinder testing machine. Tests were conducted at a contact pressure of 2.2 GPa and a slip rate of ~20% under oil lubrication condition, and the number of revolutions at the time when peeling (fatigue damage) occurred was counted as presented in Table 3. The number of revolutions can be regarded as an index of fatigue damage life of the rail and the wheel. Since it takes a long time to continue the test until peeling occurs, in this example, in the case where the rail steel was peeled off at less than 1,728,000 revolutions and where the wheel steel was peeled off at less than 2,160,000 revolutions, it was judged that satisfactory fatigue damage resistance could not be obtained with that rail steel and wheel steel combination, and the test was interrupted. In this case, for members that did not peel off, the number of revolutions in Table 2 is set to "-". On the other hand, the fatigue damage resistance was determined to be good when the number of revolutions was 1,728,000 or more for rail steels and 2,160,000 or more for wheel steels, as indicated by "no peeling" in Table 3.

It can be seen from the results in Table 3 that, the fatigue damage in a rail and a wheel can be effectively suppressed by selecting a rail steel and a wheel steel such that their chemical compositions and yield strength ratio $YS_R/YS_W$ satisfy the conditions disclosed herein. On the other hand, it will be appreciated that in those combinations not satisfying the conditions of the present disclosure, peeling occurs in a short time and fatigue damage tends to occur easily.

TABLE 1

| Steel | Chemical composition of rail steel (mass %)* | | | | | | |
|---|---|---|---|---|---|---|---|
| No. | C | Si | Mn | P | S | Cr | Remarks |
| R1-1 | 0.82 | 1.50 | 0.49 | 0.014 | 0.007 | 0.26 | Conforming Steel |
| R1-2 | 0.83 | 0.25 | 0.85 | 0.005 | 0.007 | 0.61 | Conforming Steel |
| R1-3 | 0.70 | 0.41 | 0.40 | 0.003 | 0.006 | 1.50 | Conforming Steel |
| R1-4 | 0.83 | 0.87 | 0.47 | 0.003 | 0.006 | 1.46 | Conforming Steel |
| R1-5 | 0.84 | 0.88 | 0.46 | 0.016 | 0.005 | 0.79 | Conforming Steel |
| R1-6 | 0.83 | 0.87 | 0.47 | 0.003 | 0.006 | 1.46 | Conforming Steel |
| R1-7 | 0.79 | 0.98 | 0.71 | 0.005 | 0.007 | 0.27 | Conforming Steel |
| R1-8 | 0.81 | 0.69 | 0.56 | 0.015 | 0.007 | 0.79 | Conforming Steel |
| R1-9 | 0.77 | 0.52 | 0.78 | 0.012 | 0.007 | 0.75 | Conforming Steel |
| R1-10 | 0.81 | 0.71 | 0.40 | 0.004 | 0.004 | 0.93 | Conforming Steel |
| R1-11 | 0.71 | 1.16 | 1.34 | 0.016 | 0.004 | 0.88 | Conforming Steel |
| R1-12 | 0.84 | 1.06 | 0.83 | 0.019 | 0.006 | 0.05 | Conforming Steel |
| R1-13 | 0.84 | 0.48 | 0.71 | 0.016 | 0.004 | 0.32 | Conforming Steel |
| R1-14 | 0.68 | 0.25 | 0.81 | 0.015 | 0.006 | 0.05 | Comparative Steel |
| R1-15 | 0.86 | 0.88 | 0.81 | 0.015 | 0.007 | 1.39 | Comparative Steel |
| R1-16 | 0.72 | 0.05 | 0.81 | 0.015 | 0.005 | 0.21 | Comparative Steel |
| R1-17 | 0.82 | 1.52 | 0.82 | 0.014 | 0.005 | 0.99 | Comparative Steel |
| R1-18 | 0.72 | 0.25 | 0.35 | 0.015 | 0.005 | 0.18 | Comparative Steel |
| R1-19 | 0.84 | 0.29 | 1.52 | 0.011 | 0.005 | 0.99 | Comparative Steel |
| R1-20 | 0.81 | 0.63 | 0.81 | 0.006 | 0.003 | 0.01 | Comparative Steel |
| R1-21 | 0.85 | 0.59 | 0.81 | 0.007 | 0.003 | 1.52 | Comparative Steel |
| R1-22 | 0.70 | 0.55 | 1.50 | 0.010 | 0.005 | 0.27 | Conforming Steel |
| R1-23 | 0.84 | 0.11 | 0.74 | 0.005 | 0.007 | 0.90 | Conforming Steel |
| R1-24 | 0.83 | 0.31 | 0.81 | 0.005 | 0.007 | 0.33 | Conforming Steel |
| R1-25 | 0.84 | 0.96 | 0.95 | 0.005 | 0.007 | 0.96 | Conforming Steel |

*The balance consists of Fe and inevitable impurities.

TABLE 2

| Steel | Chemical composition of wheel steel (mass %)* | | | | | | |
|---|---|---|---|---|---|---|---|
| No. | C | Si | Mn | P | S | Cr | Remarks |
| W1-1 | 0.84 | 1.01 | 1.15 | 0.012 | 0.002 | 0.09 | Conforming Steel |
| W1-2 | 0.65 | 0.29 | 1.50 | 0.015 | 0.008 | 0.20 | Conforming Steel |
| W1-3 | 0.81 | 0.75 | 0.70 | 0.019 | 0.004 | 0.34 | Conforming Steel |
| W1-4 | 0.84 | 1.50 | 0.40 | 0.007 | 0.010 | 0.33 | Conforming Steel |
| W1-5 | 0.78 | 0.25 | 0.80 | 0.012 | 0.005 | 1.50 | Conforming Steel |
| W1-6 | 0.74 | 0.27 | 0.70 | 0.019 | 0.007 | 0.22 | Conforming Steel |
| W1-7 | 0.85 | 1.00 | 0.85 | 0.008 | 0.009 | 0.39 | Conforming Steel |
| W1-8 | 0.78 | 0.10 | 0.71 | 0.005 | 0.003 | 0.24 | Conforming Steel |
| W1-9 | 0.79 | 0.26 | 0.71 | 0.015 | 0.009 | 0.22 | Conforming Steel |
| W1-10 | 0.69 | 0.33 | 0.81 | 0.019 | 0.003 | 0.22 | Conforming Steel |
| W1-11 | 0.84 | 0.28 | 0.65 | 0.003 | 0.001 | 0.05 | Conforming Steel |
| W1-12 | 0.80 | 0.22 | 0.74 | 0.015 | 0.007 | 0.20 | Conforming Steel |
| W1-13 | 0.76 | 0.21 | 0.70 | 0.004 | 0.009 | 0.21 | Conforming Steel |
| W1-14 | 0.56 | 0.69 | 0.81 | 0.011 | 0.005 | 0.31 | Comparative Steel |
| W1-15 | 0.86 | 0.39 | 0.91 | 0.015 | 0.006 | 0.77 | Comparative Steel |
| W1-16 | 0.72 | 0.05 | 0.81 | 0.015 | 0.005 | 0.19 | Comparative Steel |
| W1-17 | 0.82 | 1.52 | 0.82 | 0.014 | 0.005 | 0.99 | Comparative Steel |

TABLE 2-continued

| Steel | Chemical composition of wheel steel (mass %)* | | | | | | |
|---|---|---|---|---|---|---|---|
| No. | C | Si | Mn | P | S | Cr | Remarks |
| W1-18 | 0.72 | 0.25 | 0.35 | 0.015 | 0.005 | 0.18 | Comparative Steel |
| W1-19 | 0.84 | 0.29 | 1.52 | 0.011 | 0.005 | 0.99 | Comparative Steel |
| W1-20 | 0.74 | 0.21 | 0.77 | 0.006 | 0.003 | 0.01 | Comparative Steel |
| W1-21 | 0.85 | 0.59 | 0.81 | 0.007 | 0.003 | 1.52 | Comparative Steel |
| W1-22 | 0.75 | 0.15 | 0.75 | 0.004 | 0.005 | 0.19 | Conforming Steel |
| W1-23 | 0.68 | 0.23 | 0.71 | 0.014 | 0.003 | 0.24 | Conforming Steel |
| W1-24 | 0.79 | 0.95 | 0.95 | 0.014 | 0.003 | 0.74 | Conforming Steel |
| W1-25 | 0.69 | 0.31 | 0.69 | 0.013 | 0.007 | 0.34 | Conforming Steel |

*The balance consists of Fe and inevitable impurities.

TABLE 3

| | Rail | | | Wheel | | | Yield | | | |
|---|---|---|---|---|---|---|---|---|---|---|
| | Steel | Steel | Yield strength | Steel | Steel | Yield strength | strength ratio | Number of revolutions when peeling occurred | | |
| No. | No. | microstructure* | $YS_R$ (MPa) | No. | microstructure* | $YS_W$ (MPa) | $YS_R/YS_W$ | Rail | Wheel | Remarks |
| 1 | R1-1 | P | 875 | W1-12 | P | 709 | 1.23 | no peeling | no peeling | Example |
| 2 | R1-2 | P | 890 | W1-13 | P | 646 | 1.38 | no peeling | no peeling | Example |
| 3 | R1-3 | P | 860 | W1-11 | P | 727 | 1.18 | no peeling | no peeling | Example |
| 4 | R1-4 | P | 1135 | W1-10 | P | 582 | 1.95 | no peeling | no peeling | Example |
| 5 | R1-5 | P | 948 | W1-8 | P | 678 | 1.40 | no peeling | no peeling | Example |
| 6 | R1-6 | P | 1135 | W1-9 | P | 711 | 1.60 | no peeling | no peeling | Example |
| 7 | R1-7 | P | 835 | W1-7 | P | 983 | 0.85 | no peeling | no peeling | Example |
| 8 | R1-8 | P | 896 | W1-1 | P | 953 | 0.94 | no peeling | no peeling | Example |
| 9 | R1-9 | P | 865 | W1-2 | P | 661 | 1.31 | no peeling | no peeling | Example |
| 10 | R1-10 | P | 907 | W1-3 | P | 832 | 1.09 | no peeling | no peeling | Example |
| 11 | R1-11 | P | 1006 | W1-7 | P | 983 | 1.02 | no peeling | no peeling | Example |
| 12 | R1-12 | P | 877 | W1-4 | P | 922 | 0.95 | no peeling | no peeling | Example |
| 13 | R1-13 | P | 857 | W1-12 | P | 709 | 1.21 | no peeling | no peeling | Example |
| 14 | R1-14 | P | 780 | W1-5 | P | 1055 | 0.74 | 1080000 | — | Comparative Example |
| 15 | R1-15 | P | 1074 | W1-23 | P | 532 | 2.02 | — | 472500 | Comparative Example |
| 16 | R1-16 | P | 770 | W1-1 | P | 953 | 0.81 | 1231200 | — | Comparative Example |
| 17 | R1-17 | P | 1083 | W1-23 | P | 532 | 2.04 | — | 481500 | Comparative Example |
| 18 | R1-18 | P | 781 | W1-1 | P | 953 | 0.82 | 1299600 | — | Comparative Example |
| 19 | R1-19 | P | 1043 | W1-23 | P | 532 | 1.96 | — | 472500 | Comparative Example |
| 20 | R1-20 | P | 802 | W1-1 | P | 953 | 0.84 | 1436400 | — | Comparative Example |
| 21 | R1-21 | P | 1068 | W1-23 | P | 532 | 2.01 | — | 481500 | Comparative Example |
| 22 | R1-22 | P | 830 | W1-12 | P | 727 | 1.14 | no peeling | no peeling | Example |
| 23 | R1-23 | P | 931 | W1-5 | P | 1055 | 0.88 | no peeling | no peeling | Example |
| 24 | R1-4 | P | 1135 | W1-6 | P | 621 | 1.83 | no peeling | no peeling | Example |
| 25 | R1-8 | P | 896 | W1-14 | P | 452 | 1.98 | — | 733500 | Comparative Example |
| 26 | R1-13 | P | 857 | W1-15 | P | 1028 | 0.83 | 1522800 | — | Comparative Example |
| 27 | R1-6 | P | 1135 | W1-16 | P | 579 | 1.96 | — | 688500 | Comparative Example |
| 28 | R1-22 | P | 822 | W1-17 | P | 1166 | 0.70 | 1458000 | — | Comparative Example |
| 29 | R1-11 | P | 1006 | W1-18 | P | 502 | 2.00 | — | 666000 | Comparative Example |
| 30 | R1-23 | P | 931 | W1-19 | P | 1179 | 0.79 | 1666800 | — | Comparative Example |
| 31 | R1-4 | P | 1135 | W1-20 | P | 576 | 1.97 | — | 697500 | Comparative Example |
| 32 | R1-13 | P | 857 | W1-21 | P | 1221 | 0.70 | 1342800 | — | Comparative Example |
| 33 | R1-11 | P | 1006 | W1-22 | P | 627 | 1.60 | no peeling | no peeling | Example |
| 34 | R1-13 | P | 857 | W1-23 | P | 580 | 1.48 | no peeling | no peeling | Example |
| 35 | R1-24 | P | 838 | W1-23 | P | 999 | 0.84 | 1386000 | — | Comparative Example |
| 36 | R1-25 | P | 1144 | W1-23 | P | 583 | 1.96 | — | 742500 | Comparative Example |

*P: pearlite, M: martensite.

Example 2

Tests were conducted under the same conditions as in Example 1 except that rail steels having the compositions listed in Table 4 and wheel steels having the compositions in Table 5 were used. Table 6 lists the rail steel and wheel steel combinations used and the evaluation results. It can be seen from these results that the fatigue damage in a rail and a wheel can be effectively suppressed by selecting a rail steel and a wheel steel such that their chemical compositions and yield strength ratio $YS_R/YS_W$ satisfy the conditions disclosed herein.

TABLE 4

| Steel | Chemical composition of rail steel (mass %)* | | | | | | | | | | | | | | | |
|---|---|---|---|---|---|---|---|---|---|---|---|---|---|---|---|---|
| No. | C | Si | Mn | P | S | Cr | Cu | Ni | Mo | V | Nb | Al | W | B | Ti | Remarks |
| R2-1 | 0.84 | 0.55 | 0.55 | 0.014 | 0.005 | 0.79 | — | — | — | 0.05 | — | — | — | — | — | Conforming Steel |
| R2-2 | 0.84 | 0.51 | 0.61 | 0.008 | 0.004 | 0.74 | — | — | — | 0.30 | — | — | — | — | — | Conforming Steel |
| R2-3 | 0.84 | 0.25 | 1.10 | 0.006 | 0.005 | 0.25 | — | — | — | — | 0.04 | — | — | — | — | Conforming Steel |
| R2-4 | 0.84 | 0.35 | 1.05 | 0.003 | 0.004 | 0.29 | — | — | 0.3 | — | — | — | — | — | — | Conforming Steel |
| R2-5 | 0.84 | 0.55 | 0.55 | 0.011 | 0.005 | 0.62 | 0.5 | 1.0 | — | — | — | — | — | — | — | Conforming Steel |
| R2-6 | 0.84 | 0.25 | 1.20 | 0.004 | 0.005 | 0.29 | — | — | — | — | — | 0.07 | 0.20 | — | — | Conforming Steel |
| R2-7 | 0.84 | 0.88 | 0.55 | 0.005 | 0.005 | 0.45 | — | — | — | — | — | — | — | 0.003 | 0.05 | Conforming Steel |
| R2-8 | 0.84 | 0.95 | 0.56 | 0.011 | 0.005 | 0.79 | — | — | — | 0.05 | — | — | — | — | — | Conforming Steel |

*The balance consists of Fe and inevitable impurities.

TABLE 5

| Steel | Chemical composition of wheel steel (mass %)* | | | | | | | | | | | | | | | |
|---|---|---|---|---|---|---|---|---|---|---|---|---|---|---|---|---|
| No. | C | Si | Mn | P | S | Cr | Cu | Ni | Mo | V | Nb | Al | W | B | Ti | Remarks |
| W2-1 | 0.78 | 0.25 | 0.80 | 0.012 | 0.005 | 0.25 | — | — | — | 0.10 | | 0.05 | — | — | — | Conforming Steel |
| W2-2 | 0.79 | 0.21 | 0.75 | 0.015 | 0.008 | 0.20 | 0.5 | 1.0 | — | — | — | — | — | — | — | Conforming Steel |
| W2-3 | 0.81 | 0.35 | 0.78 | 0.019 | 0.004 | 0.28 | — | — | 0.2 | — | — | — | — | — | — | Conforming Steel |
| W2-4 | 0.84 | 0.33 | 0.80 | 0.007 | 0.009 | 0.25 | — | — | — | 0.20 | — | — | — | — | — | Conforming Steel |
| W2-5 | 0.78 | 0.25 | 0.80 | 0.012 | 0.005 | 0.74 | — | — | — | — | 0.05 | — | 0.20 | — | — | Conforming Steel |
| W2-6 | 0.81 | 0.27 | 0.70 | 0.019 | 0.007 | 0.22 | — | — | — | — | — | — | — | 0.003 | 0.05 | Conforming Steel |
| W2-7 | 0.84 | 0.99 | 0.84 | 0.008 | 0.007 | 0.35 | — | — | — | — | 0.05 | — | — | — | — | Conforming Steel |
| W2-8 | 0.79 | 0.11 | 0.82 | 0.005 | 0.003 | 0.29 | — | 0.10 | — | 0.05 | — | — | — | — | — | Conforming Steel |

*The balance consists of Fe and inevitable impurities.

TABLE 6

| | Rail | | | Wheel | | | Yield | | | |
|---|---|---|---|---|---|---|---|---|---|---|
| | Steel | Steel | Yield strength | Steel | Steel | Yield strength | strength Ratio | Number of revolutions when peeling occurred | | |
| No. | No. | microstructure* | $YS_R$ (MPa) | No. | microstructure* | $YS_W$ (MPa) | R/W | Rail | Wheel | Remarks |
| 1 | R2-1 | P | 924 | W2-3 | P | 776 | 1.19 | no peeling | no peeling | Example |
| 2 | R2-2 | P | 918 | W2-8 | P | 727 | 1.26 | no peeling | no peeling | Example |
| 3 | R2-3 | P | 871 | W2-1 | P | 716 | 1.22 | no peeling | no peeling | Example |
| 4 | R2-4 | P | 881 | W2-2 | P | 701 | 1.26 | no peeling | no peeling | Example |
| 5 | R2-5 | P | 885 | W2-7 | P | 952 | 0.93 | no peeling | no peeling | Example |
| 6 | R2-6 | P | 896 | W2-5 | P | 849 | 1.06 | no peeling | no peeling | Example |
| 7 | R2-7 | P | 886 | W2-6 | P | 737 | 1.20 | no peeling | no peeling | Example |
| 8 | R2-8 | P | 981 | W2-4 | P | 823 | 1.19 | no peeling | no peeling | Example |

*P: pearlite, M: martensite.

Example 3

Tests were conducted under the same conditions as in Example 1 except that rail steels having the chemical compositions listed in Table 7 and wheel steels having the compositions in Table 8 were used. In addition, the Vickers hardness $H_R$ of the finally obtained rail steel and the Vickers hardness $H_W$ of the finally obtained wheel steel were measured using a Vickers hardness testing machine with a load of 98 N, and the ratio $H_R/H_W$ of the hardness $H_R$ of the rail steel to the hardness $H_W$ of the wheel steel was determined. Table 9 lists the rail steel and wheel steel combinations used and the evaluation results.

Again, it can be seen from these results that the fatigue damage in a rail and a wheel can be effectively suppressed by selecting a rail steel and a wheel steel such that their chemical compositions and yield strength ratio $YS_R/YS_W$ satisfy the conditions disclosed herein. In addition, as described in PTL 2, it is found that even with the use of a combination of a rail steel and a wheel steel in which the ratio $H_R/H_W$ of the hardness $H_R$ of the rail steel to the hardness $H_W$ of the wheel steel is 1.00 or more and 1.30 or less is used, the fatigue damage resistance of the rail and the wheel is inferior if the yield strength of the rail steel is less than 830 MPa, the yield strength of the wheel steel is less than 580 MPa, and the yield strength ratio $YS_R/YS_W$ is out of the range of 0.85 to 1.95 disclosed herein. It is also understood that the fatigue damage resistance of the wheel is inferior when the wheel steel has a steel microstructure other than pearlite.

TABLE 7

| Steel | Chemical composition of rail steel (mass %)* | | | | | | | |
|---|---|---|---|---|---|---|---|---|
| No. | C | Si | Mn | P | S | Cr | Others | Remarks |
| R3-1 | 0.84 | 0.55 | 0.55 | 0.014 | 0.005 | 0.79 | — | Conforming Steel |
| R3-2 | 0.84 | 0.95 | 0.61 | 0.008 | 0.004 | 0.74 | — | Conforming Steel |
| R3-3 | 0.80 | 0.15 | 1.10 | 0.006 | 0.005 | 0.25 | — | Conforming Steel |
| R3-4 | 0.70 | 0.15 | 1.05 | 0.003 | 0.004 | 0.29 | — | Conforming Steel |
| R3-5 | 0.80 | 0.55 | 0.55 | 0.011 | 0.005 | 0.55 | — | Conforming Steel |
| R3-6 | 0.84 | 0.25 | 1.20 | 0.004 | 0.005 | 0.29 | — | Conforming Steel |
| R3-7 | 0.84 | 0.88 | 0.55 | 0.005 | 0.005 | 0.51 | — | Conforming Steel |
| R3-8 | 0.85 | 0.90 | 0.61 | 0.011 | 0.004 | 0.81 | — | Conforming Steel |
| R3-9 | 0.85 | 1.50 | 0.22 | 0.015 | 0.006 | 1.22 | — | Conforming Steel |
| R3-10 | 0.85 | 0.25 | 0.81 | 0.015 | 0.006 | 0.25 | — | Conforming Steel |
| R3-11 | 0.73 | 0.50 | 0.65 | 0.015 | 0.012 | 0.45 | — | Conforming Steel |

*The balance consists of Fe and inevitable impurities.

TABLE 8

| Steel | Chemical composition of wheel steel (mass %)* | | | | | | | |
|---|---|---|---|---|---|---|---|---|
| No. | C | Si | Mn | P | S | Cr | Others | Remarks |
| W3-1 | 0.78 | 0.25 | 0.80 | 0.012 | 0.005 | 0.25 | — | Conforming Steel |
| W3-2 | 0.79 | 0.21 | 0.75 | 0.015 | 0.008 | 0.20 | — | Conforming Steel |
| W3-3 | 0.81 | 0.35 | 0.78 | 0.019 | 0.004 | 0.28 | — | Conforming Steel |
| W3-4 | 0.79 | 0.99 | 0.84 | 0.008 | 0.007 | 0.35 | — | Conforming Steel |
| W3-5 | 0.69 | 0.25 | 0.75 | 0.012 | 0.005 | 0.27 | — | Conforming Steel |
| W3-6 | 0.68 | 0.27 | 0.70 | 0.019 | 0.007 | 0.22 | — | Conforming Steel |
| W3-7 | 0.84 | 0.33 | 0.80 | 0.007 | 0.009 | 0.25 | — | Conforming Steel |
| W3-8 | 0.79 | 0.11 | 0.82 | 0.005 | 0.003 | 0.29 | — | Conforming Steel |
| W3-9 | 0.63 | 0.69 | 0.81 | 0.011 | 0.005 | 0.39 | — | Conforming Steel |
| W3-10 | 0.85 | 0.39 | 0.91 | 0.015 | 0.006 | 0.72 | — | Conforming Steel |
| W3-11 | 0.75 | 0.40 | 0.20 | 0.021 | 0.002 | 0.85 | Ni: 0.10 | Conforming Steel |

*The balance consists of Fe and inevitable impurities.

TABLE 9

| | Rail | | | | Wheel | | | |
|---|---|---|---|---|---|---|---|---|
| No. | Steel No. | Yield strength $YS_R$ (MPa) | Steel microstructure* | Hardness $H_R$ HV | Steel No. | Yield strength $YS_W$ (MPa) | Steel microstructure* | Hardness $H_W$ HV |
| 1 | R3-1 | 924 | P | 412 | W3-3 | 776 | P | 359 |
| 2 | R3-2 | 978 | P | 429 | W3-8 | 727 | P | 357 |
| 3 | R3-3 | 823 | P | 371 | W3-1 | 716 | P | 343 |
| 4 | R3-4 | 772 | P | 346 | W3-2 | 701 | P | 342 |
| 5 | R3-5 | 831 | P | 386 | W3-7 | 823 | P | 385 |
| 6 | R3-6 | 896 | P | 403 | W3-5 | 569 | P | 330 |
| 7 | R3-7 | 899 | P | 406 | W3-6 | 533 | P | 314 |
| 8 | R3-8 | 1008 | P | 435 | W3-4 | 874 | P | 400 |

TABLE 9-continued

| | | | | | | | | |
|---|---|---|---|---|---|---|---|---|
| 9 | R3-9 | 1143 | P | 455 | W3-9 | 584 | P | 353 |
| 10 | R3-10 | 838 | P | 400 | W3-10 | 998 | P | 400 |
| 11 | R3-11 | 910 | P | 420 | W3-11 | 880 | Tempering M | 360 |

| No. | Yield strength ratio $YS_R/YS_W$ | Hardness ratio $H_R/H_W$ | Number of revolutions when peeling occurred Rail | Wheel | Remarks |
|---|---|---|---|---|---|
| 1 | 1.19 | 1.15 | no peeling | no peeling | Example |
| 2 | 1.35 | 1.20 | no peeling | no peeling | Example |
| 3 | 1.15 | 1.08 | 1436400 | — | Comparative Example |
| 4 | 1.10 | 1.01 | 1080000 | — | Comparative Example |
| 5 | 1.01 | 1.00 | no peeling | no peeling | Example |
| 6 | 1.57 | 1.22 | — | 481500 | Comparative Example |
| 7 | 1.69 | 1.29 | — | 472500 | Comparative Example |
| 8 | 1.15 | 1.09 | no peeling | no peeling | Example |
| 9 | 1.96 | 1.29 | — | 481500 | Comparative Example |
| 10 | 0.84 | 1.00 | 1436400 | — | Comparative Example |
| 11 | 1.03 | 1.17 | — | 1440000 | Comparative Example |

*P: pearlite, M: martensite.

REFERENCE SIGNS LIST

1 wheel material
2 rail material

The invention claimed is:

1. A method for selecting a combination of a rail steel and a wheel steel comprising:

preparing a plurality of rail steels each having a chemical composition containing, by mass %,
C: 0.70% or more and less than 0.85%,
Si: 0.10% to 1.50%,
Mn: 0.40% to 1.50%, and
Cr: 0.05% to 1.50%,
with the balance of Fe and inevitable impurities, preparing a plurality of wheel steels each having a chemical composition containing, by mass %,
C: 0.57% or more and less than 0.85%,
Si: 0.10% to 1.50%,
Mn: 0.40% to 1.50%, and
Cr: 0.05% to 1.50%,
with the balance of Fe and inevitable impurities, measuring yield strengths $YS_R$ of the rail steels and yield strengths $YS_W$ of the wheel steels, and selecting one of the rail steels and one of the wheel steels such that a combination of the selected rail steel and wheel steel satisfies the following conditions:

$$YS_R \geq 830 \text{ MPa},$$

$$580 \text{ MPa} \leq YS_W \leq 1000 \text{ MPa, and}$$

$$1.02 \leq YS_R/YS_W \leq 1.95 \quad (1).$$

2. The method for selecting a combination of a rail steel and a wheel steel according to claim 1, wherein the chemical composition of each of the rail steel further contains, by mass %, at least one selected from the group consisting of
Cu: 1.0% or less,
Ni: 1.0% or less,
V: 0.30% or less,
Nb: 0.05% or less,
Mo: 0.5% or less,
W: 0.5% or less,
Al: 0.07% or less,
Ti: 0.05% or less, and
B: 0.005% or less.

3. The method for selecting a combination of a rail steel and a wheel steel according to claim 2, wherein the chemical composition of each of the wheel steel further contains, by mass %, at least one selected from the group consisting of
Cu: 1.0% or less,
Ni: 1.0% or less,
V: 0.30% or less,
Nb: 0.05% or less,
Mo: 0.5% or less,
W: 0.5% or less,
Al: 0.07% or less,
Ti: 0.05% or less, and
B: 0.005% or less.

4. The method for selecting a combination of a rail steel and a wheel steel according to claim 1, wherein the chemical composition of each of the wheel steel further contains, by mass %, at least one selected from the group consisting of
Cu: 1.0% or less,
Ni: 1.0% or less,
V: 0.30% or less,
Nb: 0.05% or less,
Mo: 0.5% or less,
W: 0.5% or less,
Al: 0.07% or less,
Ti: 0.05% or less, and
B: 0.005% or less.

* * * * *